US012006942B2

(12) United States Patent
Huang et al.

(10) Patent No.: US 12,006,942 B2
(45) Date of Patent: Jun. 11, 2024

(54) SERIAL-TYPE DIAGONAL FAN ASSEMBLY

(71) Applicant: Delta Electronics, Inc., Taoyuan (TW)

(72) Inventors: Po-Wei Huang, Taoyuan (TW); Chien-Ming Lee, Taoyuan (TW); Shun-Chen Chang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 27 days.

(21) Appl. No.: 17/410,767

(22) Filed: Aug. 24, 2021

(65) Prior Publication Data

US 2021/0381515 A1 Dec. 9, 2021

Related U.S. Application Data

(63) Continuation-in-part of application No. 16/591,917, filed on Oct. 3, 2019, now Pat. No. 11,136,987.

(30) Foreign Application Priority Data

Jan. 4, 2019 (CN) ..... 201910008364.7
Jul. 6, 2021 (CN) ..... 202121517555.5

(51) Int. Cl.

| | |
|---|---|
| ***F04D 19/00*** | (2006.01) |
| ***F04D 29/38*** | (2006.01) |
| ***F04D 29/52*** | (2006.01) |
| ***F04D 29/70*** | (2006.01) |

(52) U.S. Cl.

CPC ..... *F04D 19/007* (2013.01); *F04D 19/002* (2013.01); *F04D 29/386* (2013.01); *F04D 29/522* (2013.01); *F04D 29/703* (2013.01)

(58) Field of Classification Search

CPC .. F04D 19/002; F04D 19/007; F04D 25/0613; F04D 29/386; F04D 29/522; F04D 29/541; F04D 29/703; F04D 29/54; F04D 29/544

See application file for complete search history.

(56) References Cited

U.S. PATENT DOCUMENTS 4,244,127 A * 1/1981 Buzzard ..... G09F 1/12 40/729
4,909,711 A * 3/1990 Burgbacher ..... F04D 29/325 415/218.1
6,386,843 B1 * 5/2002 Umeda ..... F04D 29/545 415/223

(Continued)

*Primary Examiner* — Devon C Kramer
*Assistant Examiner* — Joseph S. Herrmann
(74) *Attorney, Agent, or Firm* — Chun-Ming Shih; HDLS IPR SERVICES

(57) ABSTRACT

A serial-type diagonal fan assembly having a first fan and at least one second fan is provided. The first fan has a first front fan frame and a first fan wheel. A first hub of the first fan wheel has a radial cross-sectional area increased from a top toward a bottom of the first hub. The second fan has a second front fan frame and a second fan wheel, the second hub of the second fan wheel has an axial cross-sectional area increased from a top to a bottom of the second hub. The first fan and the second fan are arranged in a series. A spoiler is arranged on a second air inlet of the second front fan frame, an outer edge of the spoiler is embedded in a positioning groove of the second front fan frame without protruding from the second front fan frame.

15 Claims, 7 Drawing Sheets

(56) References Cited

U.S. PATENT DOCUMENTS

| | | | | |
|---|---|---|---|---|
| 8,678,785 | B2 * | 3/2014 | Nogami | F04D 29/083 415/174.3 |
| 10,711,790 | B2 * | 7/2020 | Hakozaki | F04D 29/544 |
| 11,268,540 | B2 * | 3/2022 | Eskew | F04D 19/002 |
| 2004/0191057 | A1 * | 9/2004 | Lee | F04D 29/703 415/121.1 |
| 2007/0081888 | A1 * | 4/2007 | Harrison | F04D 19/007 257/E23.099 |
| 2007/0258812 | A1 * | 11/2007 | Lee | F04D 29/384 415/220 |
| 2008/0031722 | A1 * | 2/2008 | Yoshida | F04D 19/007 415/68 |
| 2008/0124232 | A1 * | 5/2008 | Lee | F04D 29/601 417/423.5 |
| 2013/0209294 | A1 * | 8/2013 | Iwamoto | F04D 25/0613 417/423.14 |
| 2015/0016989 | A1 * | 1/2015 | Kang | F04D 19/002 415/214.1 |
| 2016/0097402 | A1 * | 4/2016 | Yamagata | F04D 29/703 417/423.7 |
| 2018/0100518 | A1 * | 4/2018 | Sun | F04D 19/007 |
| 2018/0258947 | A1 * | 9/2018 | Hirose | F04D 29/325 |

* cited by examiner

SERIAL-TYPE DIAGONAL FAN ASSEMBLY

CROSS-REFERENCE TO RELATED APPLICATION

This application is a continuing-in-part application of U.S. patent application Ser. No. 16/591,917, filed on Oct. 3, 2019, and entitled "SERIES-CONNECTED FAN". The entire disclosures of the above application are all incorporated herein by reference.

BACKGROUND

Technical Field

This disclosure is related to a serial-type diagonal fan assembly, in particular to a serial-type diagonal fan assembly having a second fan with a spoiler embedded therein.

Description of Related Art

Fans are developed toward high performance and low noise following the improvement of the system equipment, and the reduction of noise is a goal of fan manufacturers. A related-art axial fan is easy to be manufactured, simple to be assembled, and the cost is low. However, the noise caused by air flow is greater under an air intake with high flux.

In views of this, in order to solve the above disadvantage, the inventor studied related technology and provided a reasonable and effective solution in this disclosure.

SUMMARY

This disclosure provides a serial-type diagonal fan assembly having a second fan with a spoiler embedded therein.

This disclosure provides a serial-type diagonal fan assembly having a first fan and at least one second fan. The first fan has a first rear fan frame, a first front fan frame covering the first rear fan frame, and a first fan wheel arranged in the first front fan frame, the first fan wheel is disposed pivotally in the first rear fan frame and located in the first front fan frame, the first fan wheel has a first hub and a plurality of first blades. The first blades are annularly arranged on a periphery of the first hub and rotate around a rotary shaft. A cross-sectional area of the first hub along the rotary shaft, namely an axial cross-sectional area, is increased along a direction from a top of the first hub toward a bottom the first hub. The second fan has a second rear fan frame, a second front fan frame covering on the second rear fan frame, and a second fan wheel arranged in the second front fan frame, the second fan wheel is disposed pivotally in the second rear fan frame and located in the second front fan frame, the second fan wheel has a second hub and a plurality of second blades. The second blades are annularly arranged on a periphery of the second hub and rotate around a rotary shaft. A cross-sectional area of the second hub along the rotary shaft, namely an axial cross-sectional area, is increased along a direction from a top of the second hub toward a bottom the second hub. One end of the second front fan frame of the second fan is a second air inlet which is connected with the first rear fan frame of the first fan. The other end of the second front fan frame of the second fan connected with the second rear fan frame is a second outlet. The second outlet is connected with the second rear fan frame, a positioning groove for accommodating a spoiler is further defined on an inner wall of the second air inlet, an outer edge of the spoiler is mortised in the positioning groove so that the spoiler is not protruded from the second front fan frame.

According to the serial-type diagonal fan assembly of this disclosure, the first fan further has a first base connected with the first rear fan frame. The first rear fan frame is disposed to surround the first base, and the first fan wheel is connected pivotally with the first base. A plurality of first stationary vanes connected to the first rear fan frame are arranged annularly on a periphery of the first base.

The second fan further has a second base connected with the second rear fan frame, the second rear fan frame is arranged to surround the second base, and the second fan wheel is connected pivotally with the second base. A plurality of second stationary vanes connected with the second rear fan frame are arranged annularly on a periphery of the second base.

According to the serial-type diagonal fan assembly of this disclosure, the first fan and the second fan are arranged in a series. One end of the first front fan frame of the first fan without a connection with the first rear fan frame is a first air inlet, the other end of the first front fan frame is a first outlet, a diverged circular conical surface is arranged on an inner edge of the first air inlet, and the first outlet is connected with the first rear fan frame. One end of the second front fan frame of the second fan without a connection with the second rear fan frame is a second air inlet. A positioning groove for accommodating the spoiler is arranged on a side of second air inlet adjacent to the first rear fan frame. A diverged circular surface, which is extended from an inner edge of the second front fan frame, is connected with the positioning groove. The spoiler is separated from the first rear fan frame.

According to the serial-type diagonal fan assembly of this disclosure, the first hub of the first fan covers the first base, and the second hub of the second fan covers the second base. The first hub and the second hub are disposed toward the same direction, namely in a co-directional configuration.

According to the serial-type diagonal fan assembly of this disclosure, an end edge of the first blade of the first fan is matched with an inner wall of the first front fan frame in contour so that a gap with uniform width is defined between the end edge of each first blade and the inner wall of the first front fan frame. An end edge of each second blade of the second front fan frame is matched with an inner wall of the second front fan frame in contour so that a gap with uniform width is defined between the end edge of each second blade and the inner wall of the second front fan frame.

The serial-type diagonal fan assembly of this disclosure may be provided with a plurality of second fans, the second fans are arranged in a series, and the rotary shafts of the second fans are substantially stacked (overlapped) to each other.

According to the serial-type diagonal fan assembly of this disclosure, the spoiler may be accommodated in the first rear fan frame of the first fan.

According to the serial-type diagonal fan assembly of this disclosure, a plurality of hooks are protruded from an opening edge of the positioning groove, and the hooks latch an edge of the spoiler. Therefore, the spoiler is accommodated in a space enclosed by the inner wall of the second air inlet and the hook.

According to the serial-type diagonal fan assembly of this disclosure, a pin is protruded from an inner wall of the positioning groove of the second fan, and the pin is mortised in a hole on the spoiler.

According to the serial-type diagonal fan assembly of this disclosure, the spoiler is embedded in the second fan to introduce a tail flow from the first fan, and thereby the noises caused by the serial-type diagonal fan assembly may be reduced.

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
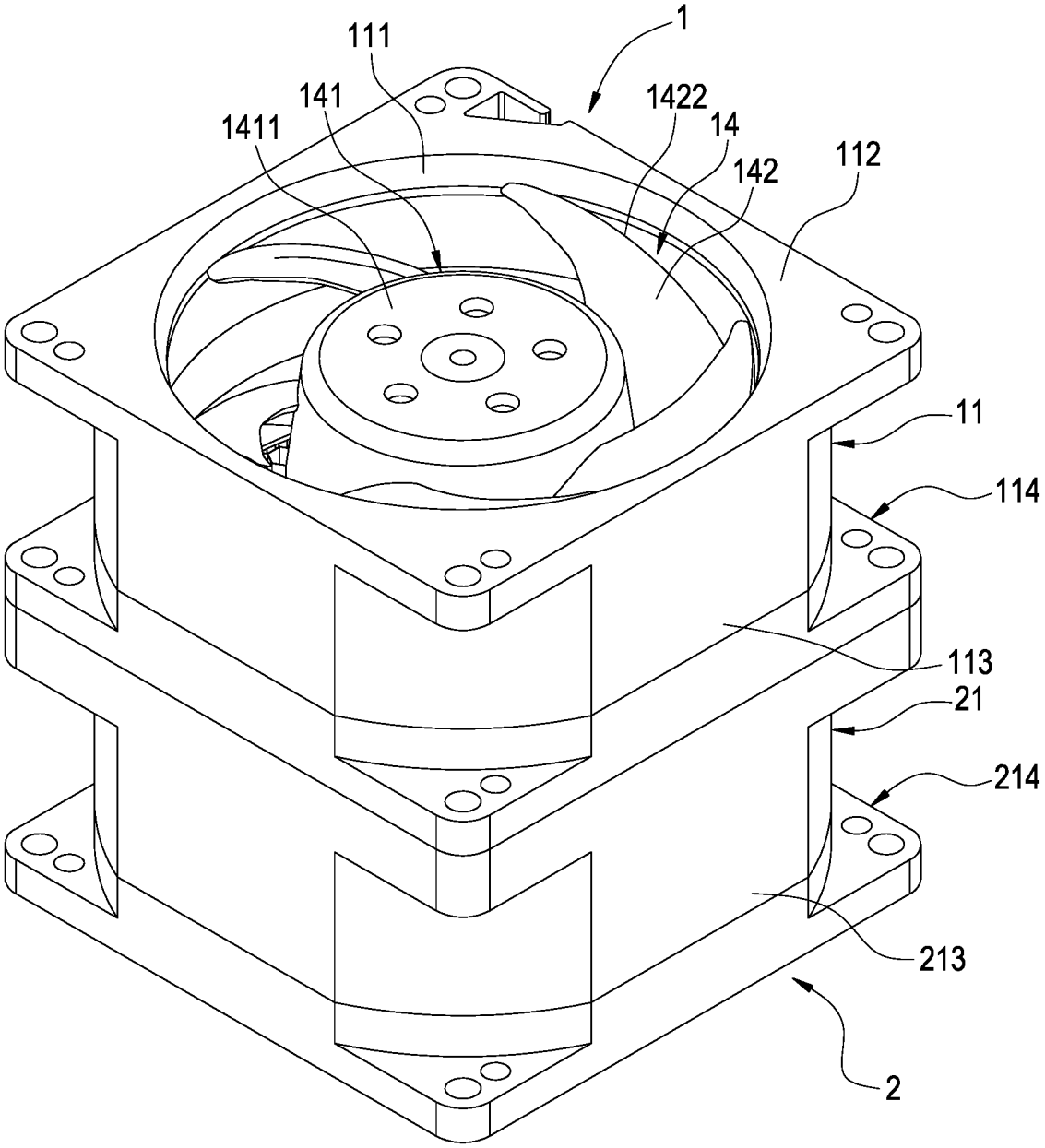
FIG. 1 is a perspective view showing a serial-type diagonal fan assembly according to the first embodiment of this disclosure.

According to FIG. 1, the first embodiment of this disclosure provides a serial-type diagonal fan assembly having a first fan 1 and a second fan 2.

Figure 2:
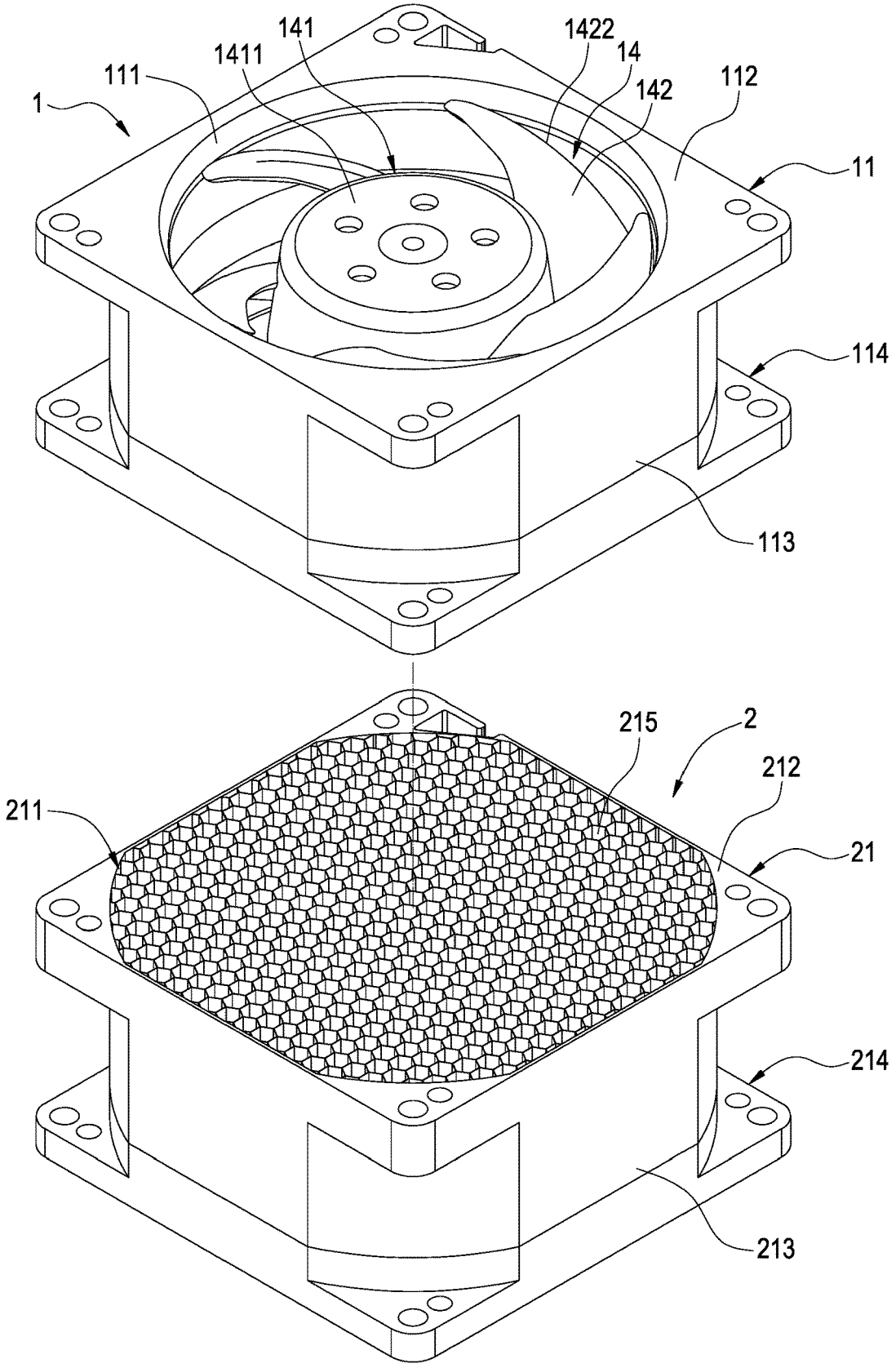
FIGS. 2 and 3 are the exploded views showing the serial-type diagonal fan assembly according to the first embodiment of this disclosure.

According to this embodiment shown in FIG. 2, the first fan 1 has a first rear fan frame 114, a first front fan frame 11 and a first fan wheel 14.

Figure 4:
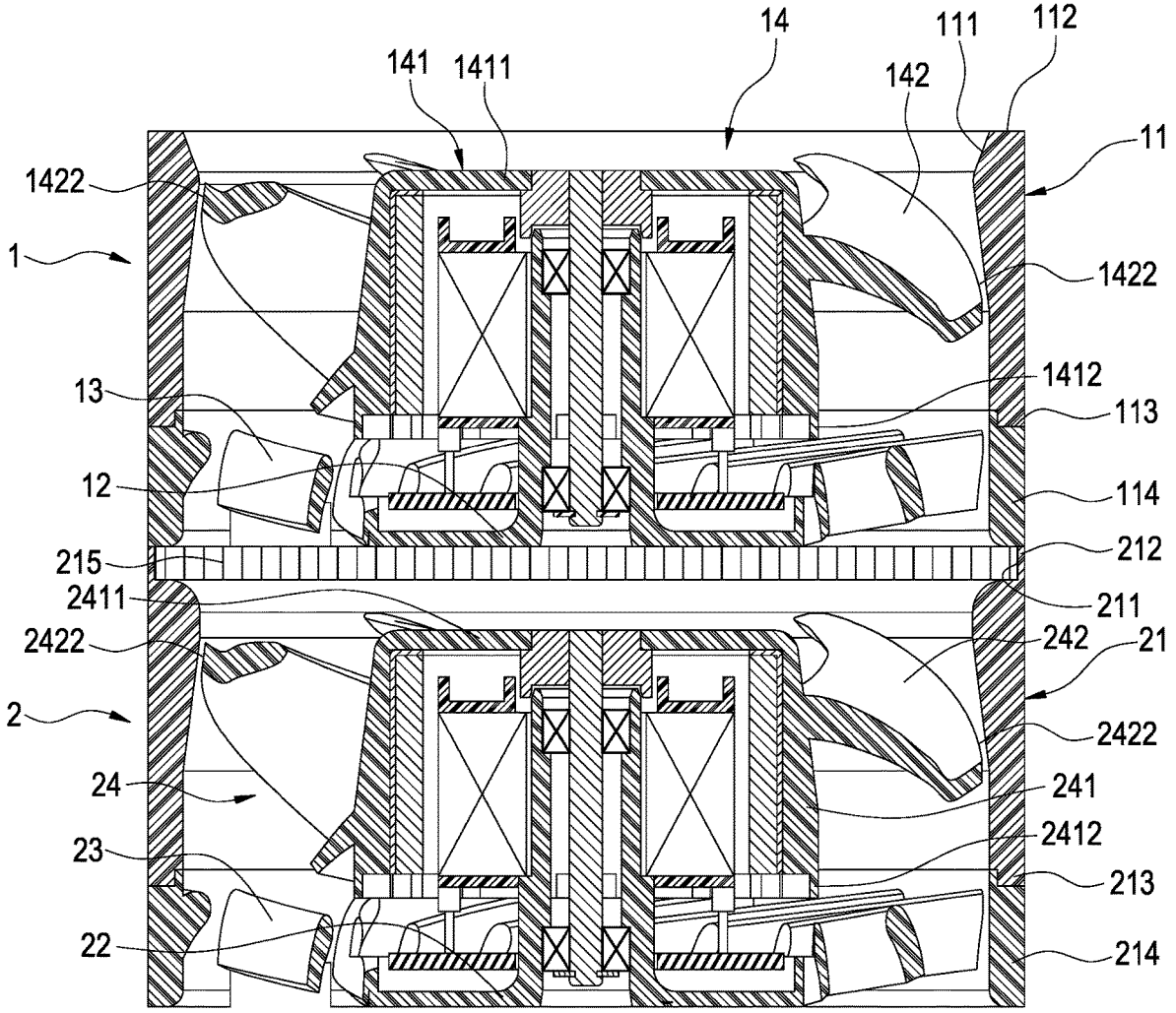
FIG. 4 is a longitudinal cross-sectional view of FIG. 1.

According to FIGS. 2 and 4, the first fan 1 further has a first base 12 connected with the first rear fan frame 114, and the first rear fan frame 114 surrounds the first base 12. A plurality of first stationary vanes 13 are connected between the first base 12 and the first rear fan frame 114. The first stationary vanes 13 are annularly arranged on a periphery of a first base 12 and further connected with the first rear fan frame 114.

The first front fan frame 11 covers the first rear fan frame 114, one end of the first front fan frame 11 is a first air inlet 112, the other end of the first front fan frame 11 is a first outlet 113, an diverged circular conical surface is arranged (formed) on an inner edge 111 of the first air inlet 112, and the first outlet 113 is connected with the first rear fan frame 114.

The first fan wheel 14 is disposed pivotally in the first rear fan frame 114 and located in the first front fan frame 11. Specifically, the first fan wheel 14 is connected pivotally to the first base 12. The first fan wheel 14 has a first hub 141 and a plurality of first blades 142. The first blades 142 are annularly arranged on a periphery of the first hub 141 and rotate around a rotary shaft. The first hub 141 has across-sectional area along the rotary shaft, namely an area of an axial cross section, which is increased along a direction from a top 1411 of the first hub 141 toward a bottom 1412 of the first hub 141. The first hub 141 covers the first base 12, an end edge 1422 of each first blade 142 has a contour matched with a contour of an inner wall of the first front fan frame 11 so that a gap with uniform width is defined between the end edge 1422 of each second blade 142 and the inner wall of the first front fan frame 11.

In this embodiment, the first stationary vanes 13 are accommodated in the first rear fan frame 114 and are not protruded from the first rear fan frame 114 so as to avoid interfering with an assembly process of the first front fan frame 11 and the first rear fan frame 114, and to avoid interfering with the first blades 142.

Figure 3:
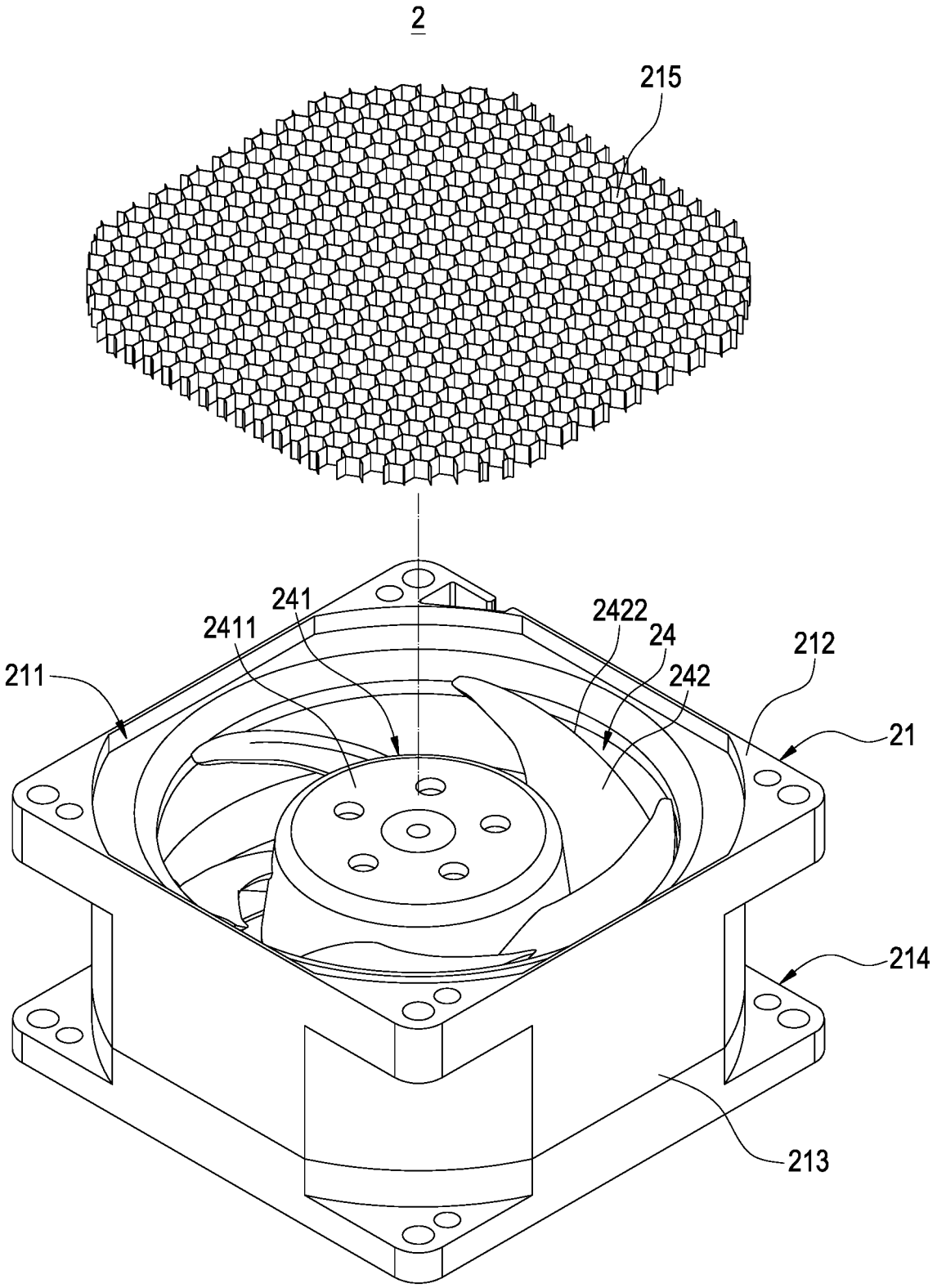

According to this embodiment shown in FIGS. 2 and 3, the second fan 2 further has a second rear fan frame 214, a second front fan frame 21 and a second fan wheel 24.

According to FIGS. 3 and 4, the second fan 2 further has a second base 22 connected with the second rear fan frame 214, the second rear fan frame 214 surrounds the second base 22, and a plurality of second stationary vanes 23 are connected between the second base 22 and the second rear fan frame 214. The second stationary vanes 23 are annularly arranged on a periphery of the second base 22 and rotate around a rotary shaft.

The second front fan frame 21 covers the second rear fan frame 214, one end of the second front fan frame 21 without a connection with the second rear fan frame 214 is a second air inlet 212. The other end of the second front fan frame 21 is a second outlet 213, the second air inlet 212 is connected with the first rear fan frame 114 and the second outlet 213 is connected with the second rear fan frame 214. The second air inlet 212 may be connected with the first rear fan frame 114 of the first fan 1. A positioning groove 211 is arranged on an inner wall of a side of the second air inlet 212 adjacent to the first rear fan frame 114, a diverged circular conical surface connected with the positioning groove 211 is arranged on an inner edge 111 of the second air inlet 212. The positioning groove 211 is used for accommodating a spoiler 215, an outer edge of the spoiler 215 is mortised in the positioning groove 211, and the spoiler 215 is not protruded from the second front fan frame 21. According to this embodiment, the positioning groove 211 may be a stepped groove or alternatively may be a channel groove, but this disclosure is not limited thereto. The spoiler 215 may be accommodated in the positioning groove 211 corresponding to an axial direction of the fans and separated from the first rear fan frame 114. This disclosure is not limited to the embodiment, the spoiler 215 alternatively may be aligned to an opening edge of the second air inlet 212 along the axial direction of the fans, and the first rear fan frame 114 may be stacked on the edge of the spoiler 215. The first base 12 may be stacked on the spoiler 215, and the spoiler 215 may be further fixed.

The second fan wheel 24 of the second fan 2 is disposed pivotally in the second rear fan frame 214 and located in the second front fan frame 21, so that the second fan wheel 24 is arranged between the first stationary vanes 13 and the second stationary vanes 23. Specifically, the second fan wheel 24 is connected pivotally to the second base 22. The second fan wheel 24 further has a second hub 241 and a plurality of second blades 242, the second blades 242 are annularly arranged on a periphery of the second hub 241. The second hub 241 has a cross-sectional area along the rotary shaft, namely an axial cross-sectional area, which is increased along a direction from a top 2411 of the second hub 241 toward a bottom 2412 of the second hub 241. The second hub 241 covers the second base 22, and the first hub 141 and the second hub 241 are arranged in a co-directional configuration. When the serial-type diagonal fan assembly according to this disclosure is in operation, air firstly flows through the top 1411 of the first hub 141, then flows through outside of the bottom 1412 of the first hub 141, and further flows through the top 2411 and outside of the of the bottom 2412 of the second hub 241. Considering a convenient assembly process, the first hub 141 is assembled to the first base 12 along the same direction with the second hub 241 being assembled on to the second base 22. In other word, the first hub 141 and the second hub 241 are arranged in a co-directional configuration.

An end edge 2422 of each second blade 242 has a contour matched with a contour of an inner wall of the second front fan frame 21 so that a gap with uniform width is defined between the end edge 2422 of each second blade 242 and the inner wall of the second front fan frame 21.

In this embodiment, the second stationary vanes 23 are accommodated in the second rear fan frame 214 and are not protruded from the second rear fan frame 214 so as to avoid interfering with an assembly process of the second front fan frame 21 and the second rear fan frame 214, and to avoid interfering with the second blades 242.

Figure 5:
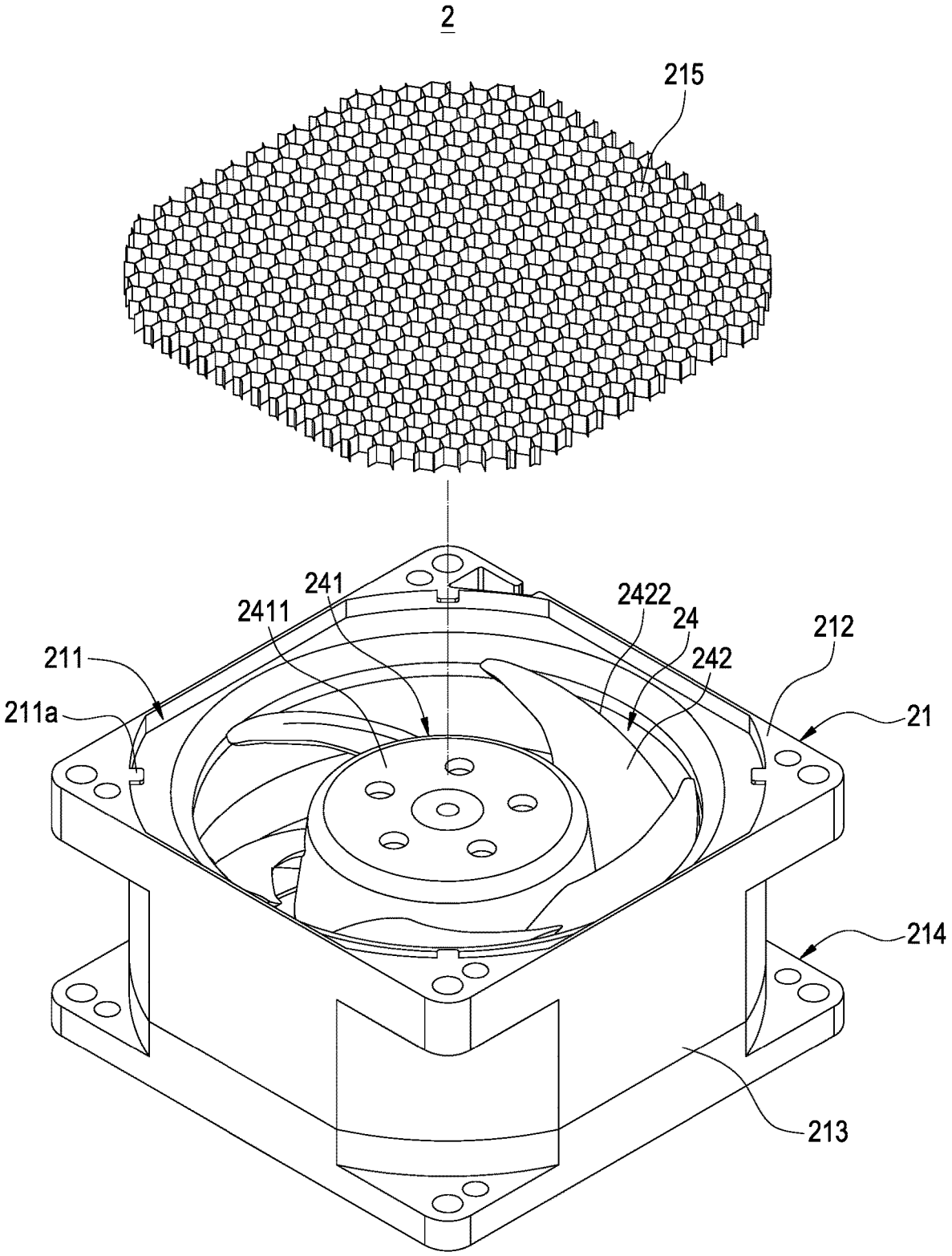
FIGS. 5 and 6 are the perspective views showing an alternative serial-type diagonal fan assembly according to the first embodiment of this disclosure.

According to FIG. 5, when the spoiler 215 is arranged in the positioning groove 211, a plurality of hooks 211*a* may be disposed to protrude from an opening edge of the positioning groove 211, the hook 211*a* latches the edge of the spoiler 215 so as to fix the spoiler 215 in the positioning groove 211.

Figure 6:
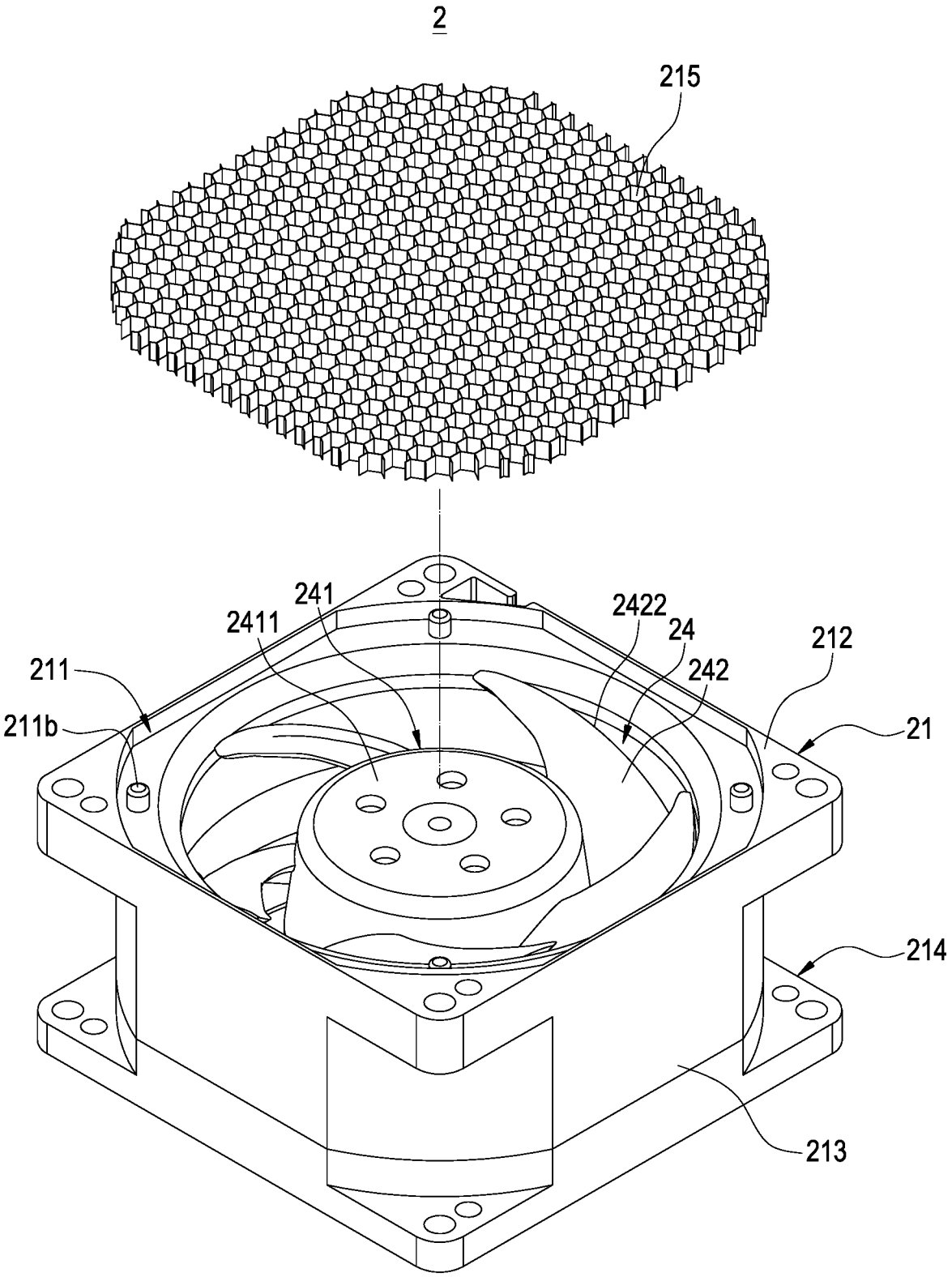

According to FIG. 6, a pin 211*b* is further disposed to protrude from an inner wall of the positioning groove 211, the pin 211*b* is extended in parallel with the axial direction of the second fan 2. The spoiler 215 may be a honeycomb grille so as to allow air to flow through spaces in the grille. Moreover, when the spoiler 215 is arranged in the positioning groove 211, the pin 211*b* is mortised in a hole on the spoiler 215 along a normal line to the spoiler 215.

Figure 7:
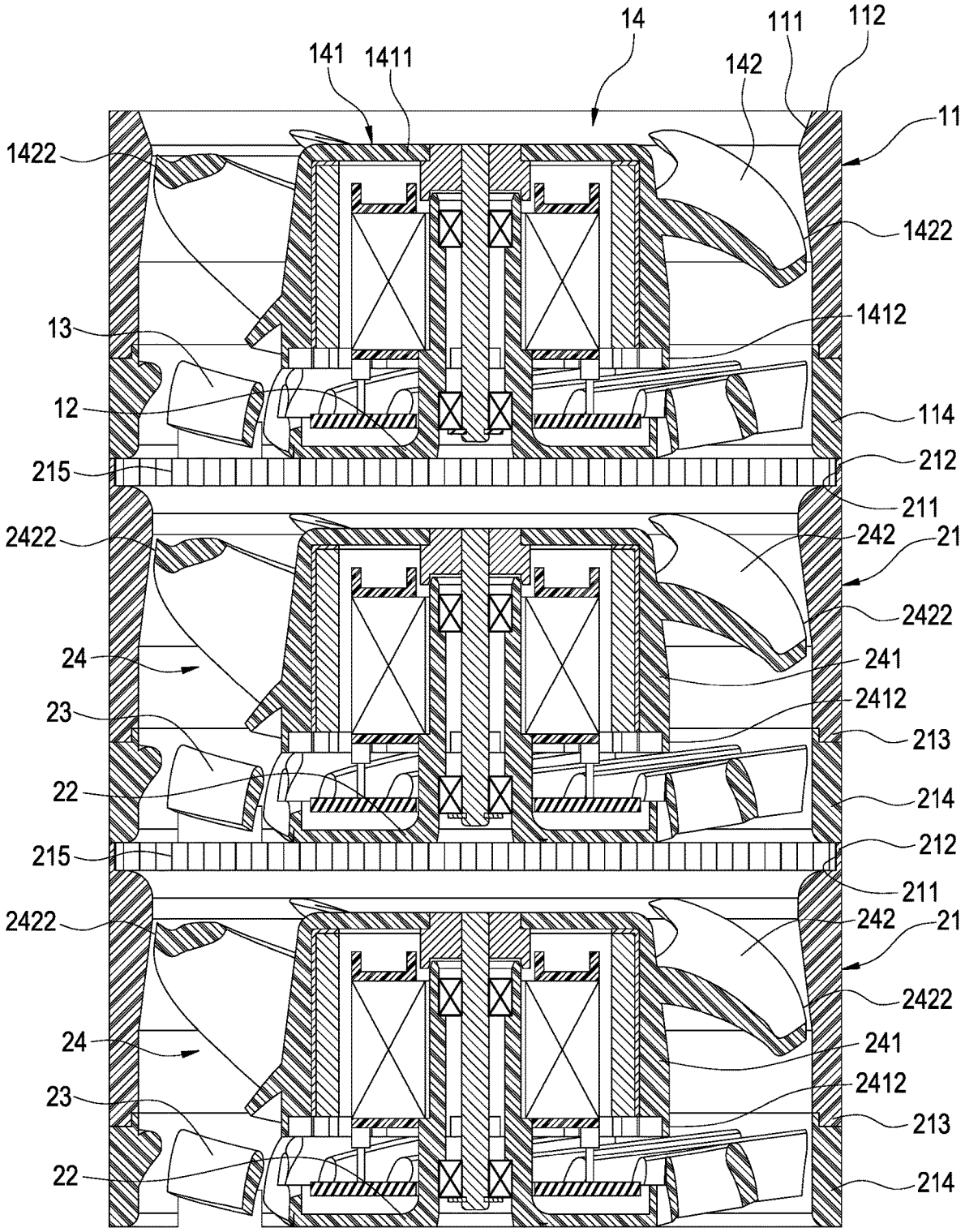
FIG. 7 is a perspective view showing a serial-type diagonal fan assembly according to the second embodiment of this disclosure.

According to FIG. 7, another embodiment of this disclosure provides a serial-type diagonal fan assembly having a first fan 1 and a plurality of second fans 2. According to this embodiment, the first fan 1 has similar structure described in the aforementioned embodiment, and each second fan 2 has similar structure described in the aforementioned embodiment. The contents the same as aforementioned embodiment are omitted here for brevity. According to this embodiment, the plurality of second fans 2 are arranged in a series so as to increase air flux of the serial-type diagonal fan assembly.

According to this embodiment, two second fans 2 are provided, the second front fan frame 213 of one of the second fans 2 is connected with the first rear fan frame 114 of the first fan 1, and that second rear fan frame 214 is connected with the second front fan frame 213 of the other second fan 2. The number of the second fans 2 is not limited, and the connection of the second fans 2 may be extended by repeating the aforementioned connection manner so as to dispose multiple second fans 2 in a series. Moreover, the first hub 141 and the respective second hub 241 are disposed in a co-directional configuration and therefore easy to be assembled. The assembling process may remain unchanged even the number of the second fans 2 is changed.

Furthermore, the spoilers 215 may be arranged in the second front fan frames 213 of the respective second fan 2 so as to introduce tail flows from the first fan 1 or the second fan 2.

According to the serial-type diagonal fan assembly of this disclosure, the second fan 2 is provided with a spoiler 215 embedded therein for introducing the trail flow from the upstream of the first fan 1 or the second fan 2, and thereby the noises caused by the serial-type diagonal fan assembly may be reduced. In particular, high frequency noises of the serial-type diagonal fan assembly of this disclosure are reduced, and the serial-type diagonal fan assembly of this disclosure may be operated in a higher speed for providing an air intake with higher flux under the allowable noise limitation.

While this disclosure has been described by means of specific embodiments, numerous modifications and variations may be made thereto by those skilled in the art without departing from the scope and spirit of this disclosure set forth in the claims.

What is claimed is:

1. A serial-type diagonal fan assembly, comprising:

a first fan, comprising a first rear fan frame, a first front fan frame covering the first rear fan frame, and a first fan wheel arranged in the first front fan frame, the first fan wheel disposed in the first rear fan frame and located in the first front fan frame, the first fan wheel comprising a first hub and a plurality of first blades, the first blades annularly arranged on a periphery of the first hub, a cross-sectional area of the first hub being increased along a first direction from a top of the first hub toward a bottom the first hub so as to form a first cone surface on the first hub, wherein a gap between the first cone surface and an internal surface of the first front fan frame is substantially uniform along the first direction, and the first blades are disposed on the first cone surface; and at least one second fan, comprising a second rear fan frame, a second front fan frame covering the second rear fan frame, and a second fan wheel arranged in the second front fan frame, the second fan wheel disposed in the second rear fan frame and located in the second front fan frame, the second fan wheel comprising a second hub and a plurality of second blades, the second blades annularly arranged on a periphery of the second hub, a cross-sectional area of the second hub being increased along a second direction from a top of the second hub toward a bottom of the second hub so as to form a second cone surface on the second hub, wherein a gap between the second cone surface and an internal surface of the second front fan frame is substantially uniform along the second direction, and the second blades are disposed on the second cone surface, wherein one end of the second front fan frame comprises a second air inlet, another end of the second front fan frame comprises a second outlet, the second air inlet is connected with the first rear fan frame and the second outlet is connected with the second rear fan frame, a positioning groove is arranged on an inner wall of the second air inlet, a spoiler is arranged in the second front fan frame and an outer edge of the spoiler is mortised in the positioning groove, wherein the first fan further comprises a first base connected with the first rear fan frame, the first base is surrounded by the first rear fan frame, and the first fan wheel is connected with the first base, and wherein the first base is stacked on the spoiler, wherein a diverged conical surface is formed by an inner edge of a first air inlet of the first front fan frame, and the top of the first hub is disposed within the diverged conical surface of the first air inlet, such that each first blade exceeds the top of the first hub and extends into a space enclosed by the diverged conical surface, and each second blade exceeds the top of the second hub.

2. The serial-type diagonal fan assembly according to claim 1, wherein the spoiler is separated from the first rear fan frame.

3. The serial-type diagonal fan assembly according to claim 1, wherein an end edge of each first blade is matched with an inner wall of the first front fan frame in contour to define a gap between the end edge of each first blade and the inner wall of the first front fan frame.

4. The serial-type diagonal fan assembly according to claim 1, wherein an end edge of each second blade is matched with an inner wall of the second front fan frame in contour to define a gap between the end edge of each second blade and the inner wall of the second front fan frame.

5. The serial-type diagonal fan assembly according to claim 1, wherein a number of the at least one second fan is a multiple, and the multiple second fans are disposed in series.

6. The serial-type diagonal fan assembly according to claim 1, wherein the first rear fan frame is stacked on an edge of the spoiler.

7. The serial-type diagonal fan assembly according to claim 1, wherein a plurality of hooks are protruded from an opening edge of the positioning groove, and the hooks latch an edge of the spoiler.

8. The serial-type diagonal fan assembly according to claim 1, wherein a pin is protruded from an inner wall of the positioning groove, and the pin is mortised in the spoiler.

9. The serial-type diagonal fan assembly according to claim 1, wherein one end of the first front fan frame is the first air inlet, the other end of the first front fan frame is a first outlet, the diverged conical surface is arranged on the inner edge of the first air inlet, and the first outlet is connected with the first rear fan frame.

10. The serial-type diagonal fan assembly according to claim 9, wherein a diverged circular surface portion of the positioning groove is arranged under the spoiler.

11. The serial-type diagonal fan assembly according to claim 1, wherein the at least one second fan further comprises a second base connected with the second rear fan frame, the second base is surrounded by the second rear fan frame, and the second fan wheel is connected with the second base.

12. The serial-type diagonal fan assembly according to claim 11, wherein first hub covers the first base, the second hub covers the second base, and the first hub and the second hub are disposed toward a same direction.

13. The serial-type diagonal fan assembly according to claim 11, wherein a plurality of first stationary vanes are connected between the first base and the first rear fan frame, and the first stationary vanes are annularly arranged on a periphery of the first base.

14. The serial-type diagonal fan assembly according to claim 13, wherein a plurality of second stationary vanes are connected between the second base and the second rear fan frame, and the second stationary vanes are annularly arranged on a periphery of the second base.

15. The serial-type diagonal fan assembly according to claim 14, wherein the second fan wheel is arranged between the first stationary vanes and the second stationary vanes.

* * * * *